US005260524A

United States Patent [19]

Schroeder et al.

[11] Patent Number: 5,260,524

[45] Date of Patent: Nov. 9, 1993

[54] MUFFLER FOR AIR COMPRESSOR AND METHOD

[75] Inventors: Alfred A. Schroeder; Michael T. Romanyszyn, Jr., both of San Antonio, Tex.

[73] Assignee: The Coca-Cola Company, Atlanta, Ga.

[21] Appl. No.: 882,995

[22] Filed: May 14, 1992

[51] Int. Cl.[5] ..... F02M 35/00

[52] U.S. Cl. ..... 181/229; 181/255; 181/282; 181/296; 181/403

[58] Field of Search ..... 181/229, 249, 255, 269, 181/282, 403, 296

[56] References Cited

U.S. PATENT DOCUMENTS

| | | | |
|---|---|---|---|
| 3,191,715 | 6/1965 | Jettinghoff | 181/255 |
| 3,340,957 | 9/1967 | Vautaw et al. | 181/255 |
| 4,109,751 | 8/1978 | Kabele | 181/255 X |
| 4,132,286 | 1/1979 | Hasui et al. | 181/269 X |
| 4,330,239 | 5/1982 | Gannaway | 181/403 |
| 4,697,668 | 10/1987 | Barker | 181/255 X |
| 5,101,931 | 4/1992 | Blass et al. | 181/403 |
| 5,107,953 | 4/1992 | Shimizu et al. | 181/255 X |

*Primary Examiner*—Michael L. Gellner
*Assistant Examiner*—Khanh Dang
*Attorney, Agent, or Firm*—Thomas R. Boston; W. Dexter Brooks

[57] ABSTRACT

A noise reduction method using a muffler for connection to the air inlet of an air compressor including an imperforate, hollow housing enclosing a chamber, air inlet and outlet openings in the housing, an air inlet tube in the housing connected to the air inlet opening and an air outlet tube in the housing connected to the air outlet opening, both tubes extending over half the length of the chamber, and the openings in the distal ends of the tubes facing in the opposite directions.

1 Claim, 5 Drawing Sheets

MUFFLER FOR AIR COMPRESSOR AND METHOD

BACKGROUND OF THE INVENTION

1. Field of the Invention

This invention relates to noise reduction mufflers for air compressors and in particular for use in a beverage dispenser.

2. Description of the Prior Art

Noise reduction mufflers for air compressors are well-known, however, they are expensive, large and do not achieve noise reduction satisfactory for use on a countertop postmix beverage dispenser.

SUMMARY OF THE INVENTION

A noise reduction muffler for connection to the air inlet of an air compressor including an imperforate, elongated, hollow housing enclosing a chamber, air inlet and outlet openings at opposite ends of said housings, an air inlet tube in said housing connected to the air inlet opening and extending over half way to the other end of the housing and an air outlet tube connected to the air outlet opening and extending over half way to the other end of the housing. The housing preferably includes a tubular cylindrical body and two disc shaped end caps with central openings therethrough.

The muffler is preferred for use with reciprocating piston air compressors and in a preferred application is used in a countertop postmix beverage dispenser of the type using an air compressor.

BRIEF DESCRIPTION OF THE DRAWINGS

The present invention will be more fully understood from the detailed description below when read in connection with the accompanying drawings wherein like reference numerals refer to like elements and wherein.

DETAILED DESCRIPTION OF THE PREFERRED EMBODIMENT

Figure 5:
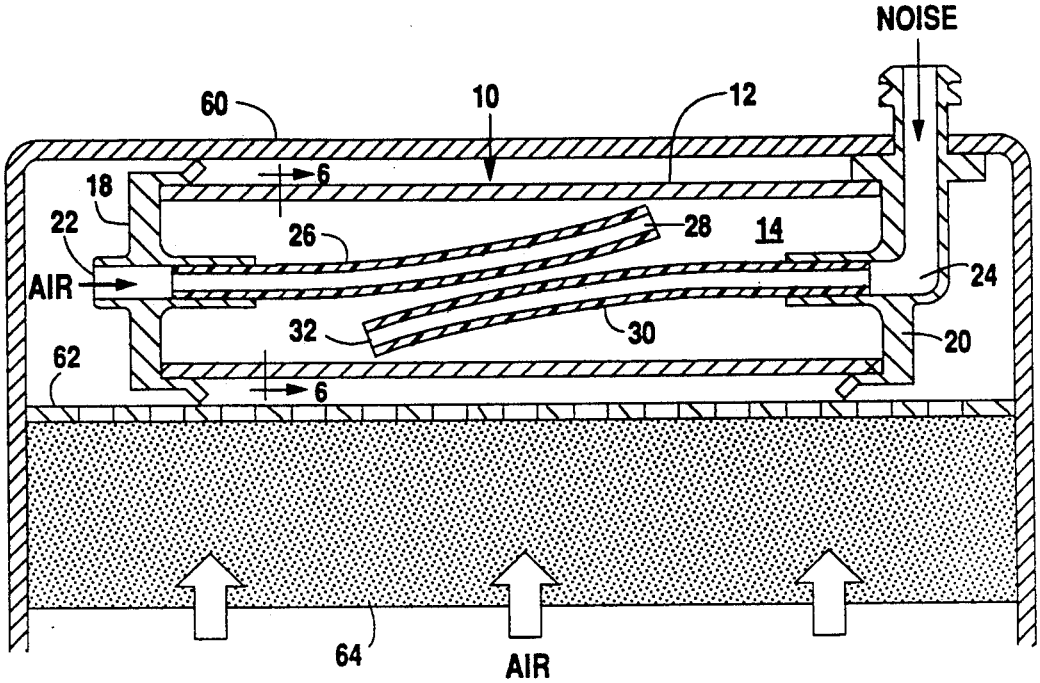
FIG. 5 is a cross-sectional side view through the muffler of the present invention.
Figure 6:
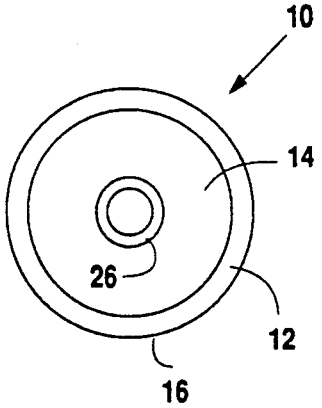
FIG. 6 is a cross-sectional view taken along line 6—6 of FIG. 5.
Figure 7:
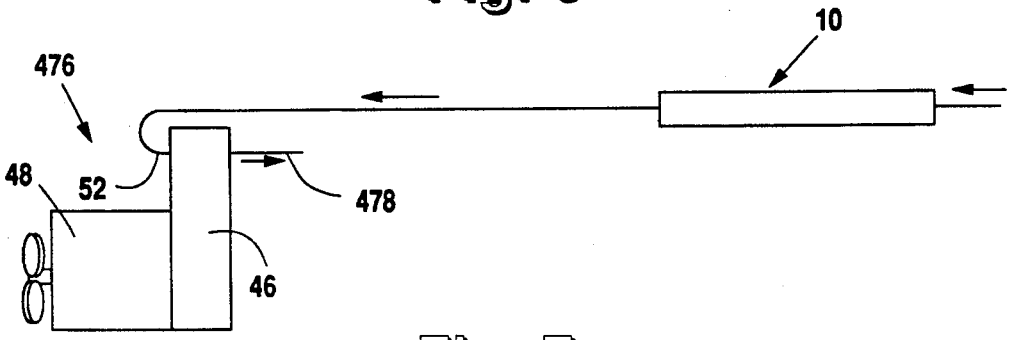
FIG. 7 is a diagrammatic view of a compressed air source.

With reference now to the drawings, FIGS. 5–7 show a noise reduction muffler 10 according to the present invention.

The muffler 10 includes a housing 12 enclosing a chamber 14 and made up of a hollow, preferably cylindrical body 16 and a pair of disc shaped end caps 18 and 20 having air inlet and outlet openings 22 and 24 therein, respectively. An air inlet tube 26 is in the chamber 14 and is connected to the air inlet opening 22 and has an air outlet opening 28 in its distal end. An air outlet tube 30 is also in the chamber 14 and is connected to the air outlet opening 24 and has an air inlet opening 32 in its distal end.

The tubes 26 and 30 each have a length greater than 50% of the length of said chamber 14 and each have a cross-sectional area substantially less than half of that of said chamber. Preferably, when used with a small reciprocating piston air compressor having an output of about one-third cubic feet per minute at 40 psi, driven by a subfractional horsepower motor, the housing 12 and tubes 26 and 30 are made of plastic with the housing having a length of about twelve inches and a diameter of about one inch, and the tubes being identical and having a length of about 7 inches and a diameter of about ⅜ inch. Other materials and sizes can be used and the muffler can be used with other types of air compressors and other devices.

The preferred application is for use in a countertop postmix beverage dispenser of the type using an air compressor.

Figure 1:
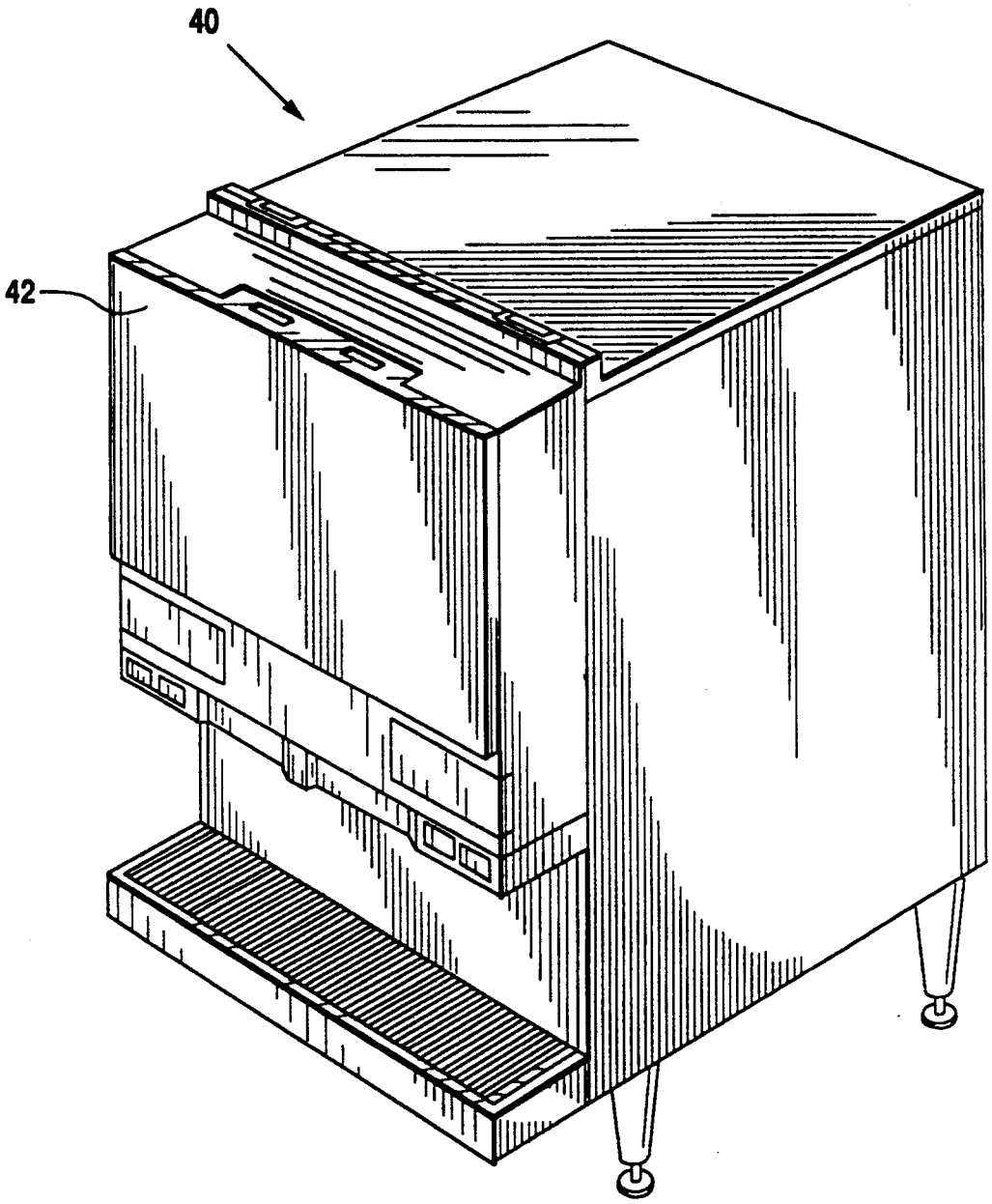
FIG. 1 is a top, front, right side perspective view of a countertop postmix beverage dispenser.
Figure 2:
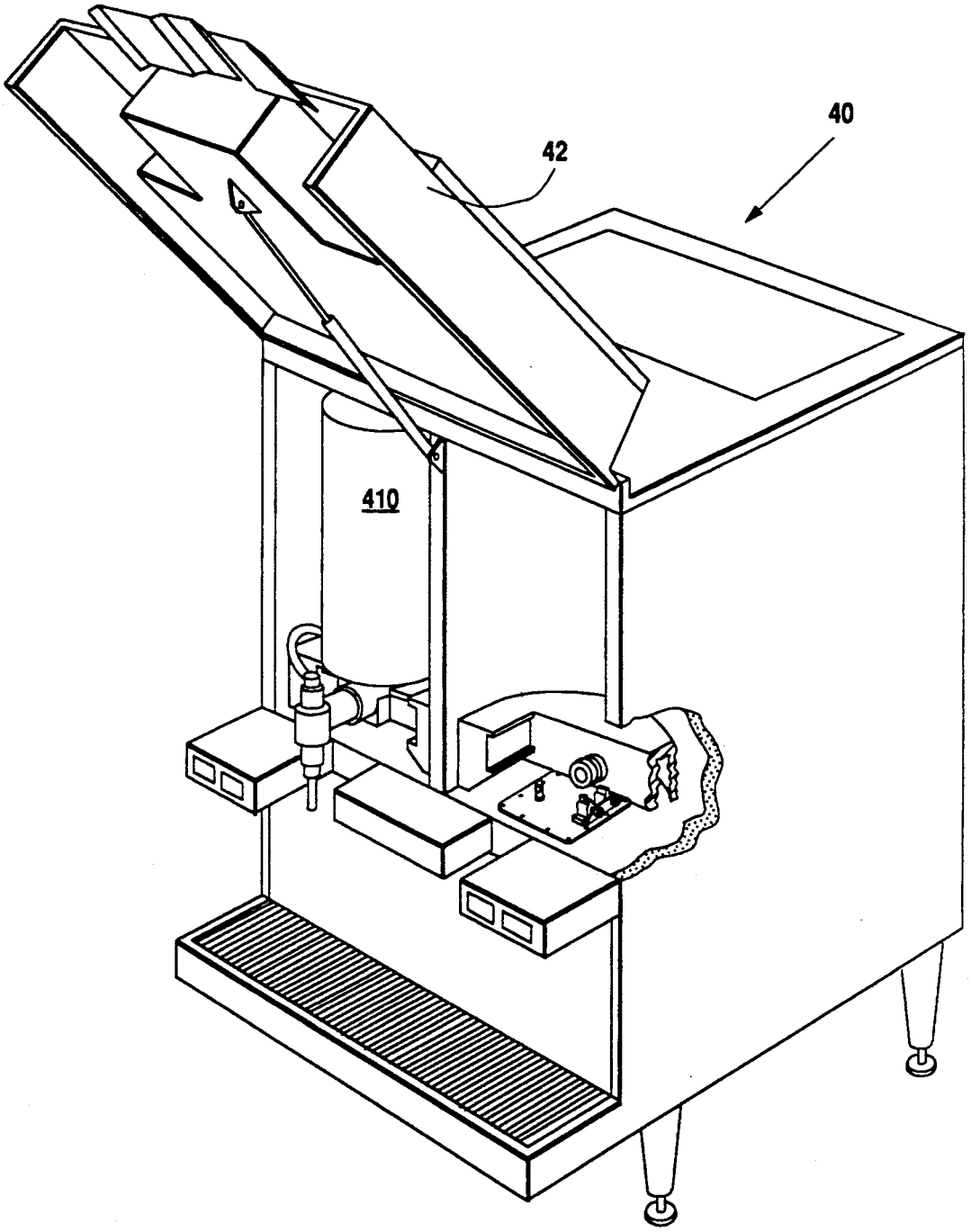
FIG. 2 is a view similar to FIG. 1 with the front cover open.
Figure 3:
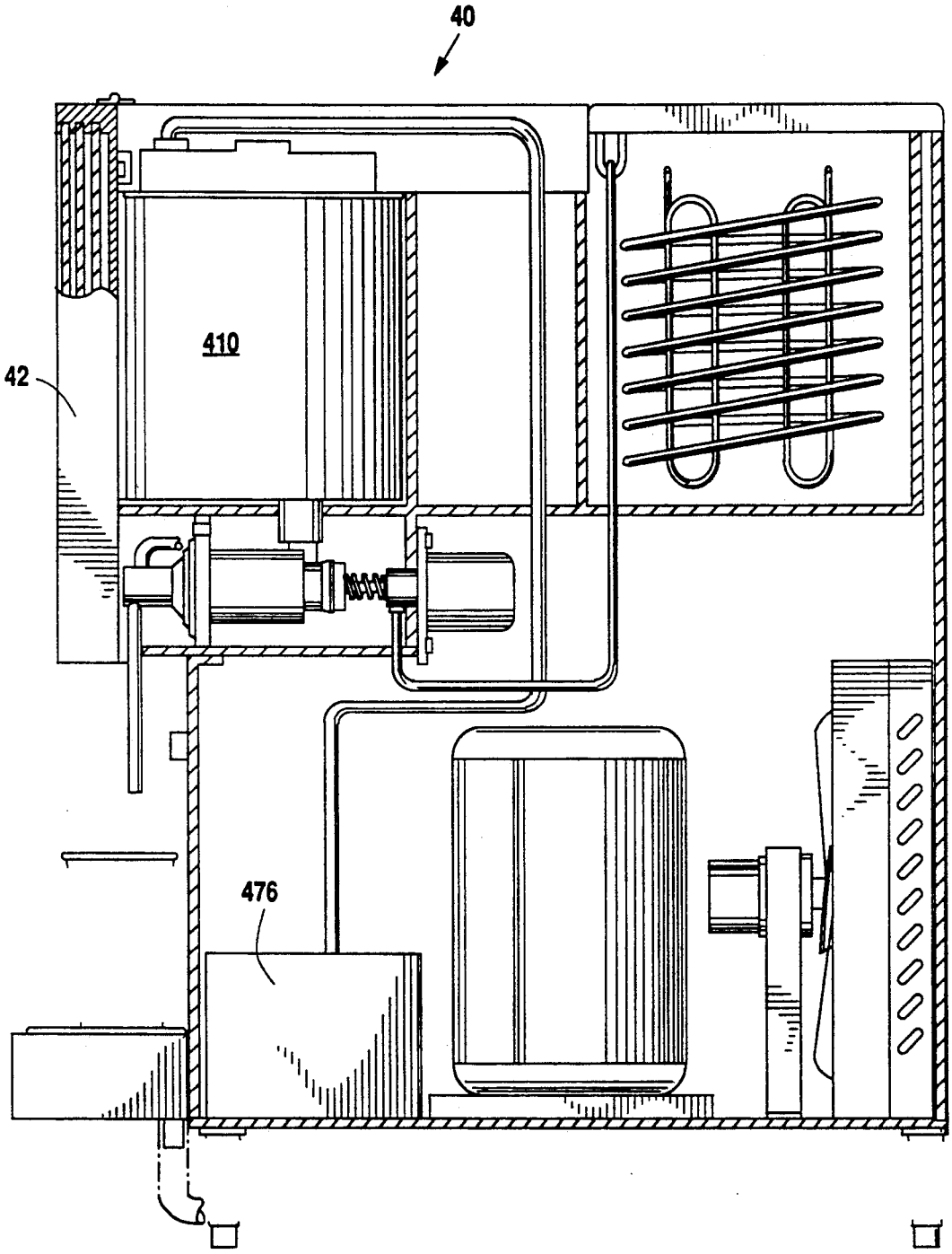
FIG. 3 is a cross-sectional side view through the dispenser of FIG. 1.

Such a dispenser 40 is shown in FIGS. 1–3. The dispenser includes a front cover 42 that opens to receive a container 410 of concentrate. FIG. 3 is a cross-sectional side view of the dispenser. FIGS. 3 and 4 show an air drive assembly for pressurizing the concentrate in the container 410 including a compressed air source 476. FIG. 7 shows an air compressor 46, a motor 48 and an air line 50. The muffler 10 is connected to the air inlet opening 52 of the compressor.

Figure 4A:
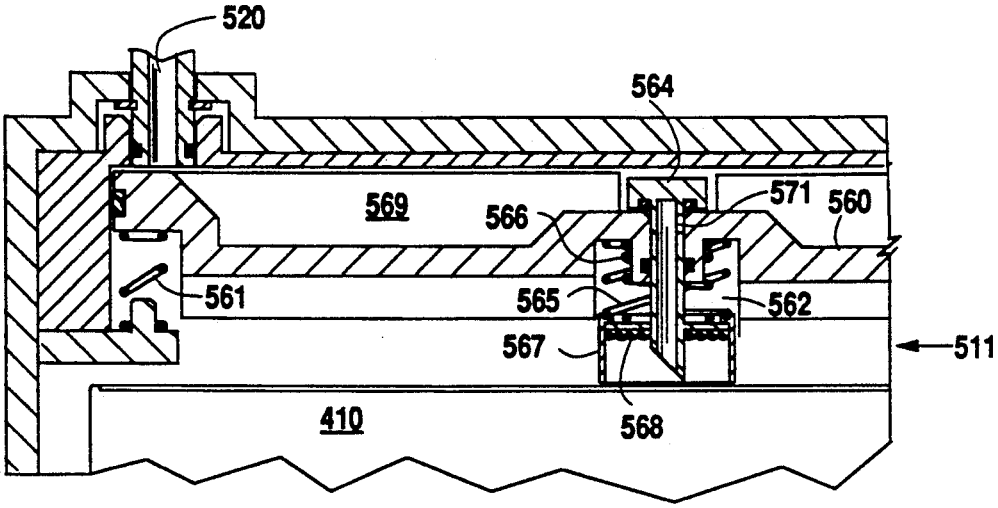
FIGS. 4A–4C are cross-sectional side views of an air drive assembly in its unpressurized, partially pressurized and fully pressurized operating positions.
Figure 4B:
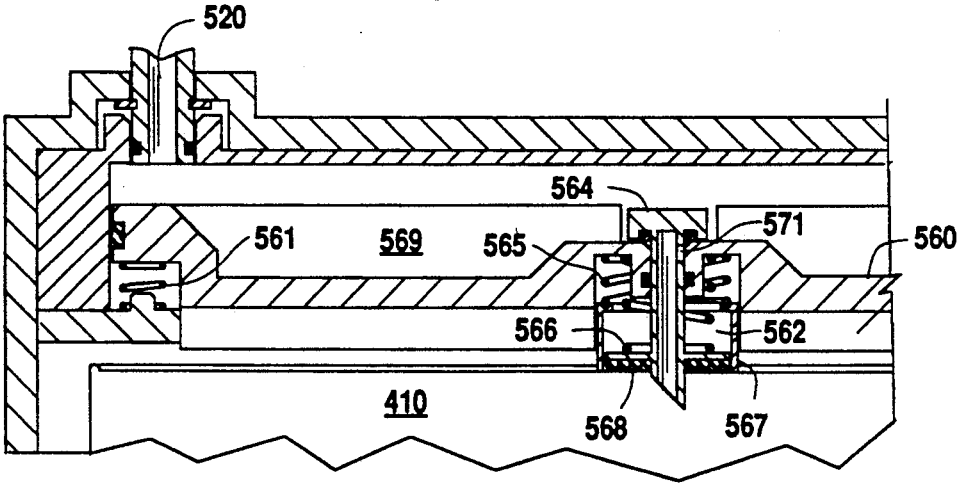
Figure 4C:
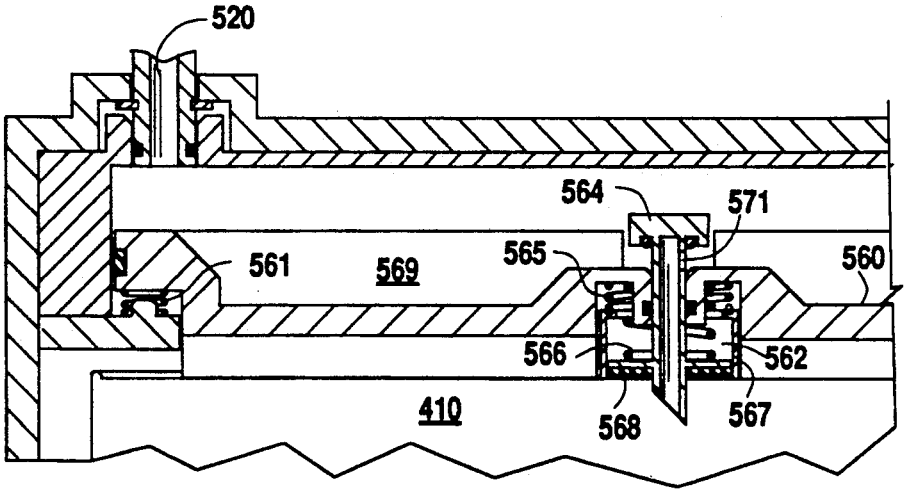

FIGS. 4A, 4B and 4C show an air drive assembly 511 that receives air from the compressed air source 476 via air line 478.

After a new concentrate package 410 is inserted, compressed air is delivered to the top of spring assembly 560 which is movably connected to spring 561. Initially, the pressure is increased causing spring 561 to compress, which lowers spring assembly 560 until an air tube or punch assembly 562 punctures container 410. Punch assembly 562 comprises hollow punch 564, spring 565, spring 566, and guard 567, all of which are attached to the plate portion of spring assembly 560. Guard 567 is a circular shroud about hollow punch 564 attached to the lower plate portion of spring assembly 560 by spring 565 used to prevent system operators from injuring themselves on the sharp point of hollow punch 564. Spring 566 allows spring assembly 560 to move relative to guard 567, thus allowing hollow punch 564 to penetrate container 410. Spring 566 is attached to flange 568 of hollow punch 564 and also to the lower plate portion of spring assembly 560. As the pressure above spring assembly 560 in cavity 569 is increased, the restoring force of spring 566 is initially strong enough to keep the head of hollow punch 564 resting on top of the plate portion of spring assembly 560 allowing hollow punch 564 to puncture canister 563. However, after container 410 has been punctured, the pressure in cavity 569 is increased such that spring 561 is fully compressed, and the restoring force of spring 566 is overcome to the extent that cavity 570 is created as shown in FIG. 4C. As spring assembly 560 is compressed away from hollow punch 564, orifice 571 in the shaft portion of hollow punch 564 is exposed. Orifice 571 delivers compressed air from cavity 569 to container 410 through the hollow shaft portion of punch 564, thereby pressurizing container 410. During operation, the pressure maintained in cavity 569 and, subsequently, above the piston 448 residing in container 410 is kept sufficiently high to provide constant pressure against the product causing that product to be forced into pump 414 on demand.

FIG. 5 shows the muffler 10 in the dispenser 40 between a wall 60 and a perforated wall 62. An air filter layer 64 such as of foam is adjacent the wall 62. Air passes through the filter 64, wall 62 and then into the muffler 10 and then to the air compressor 46. Noise passes from the air compressor 46 to the muffler but is extinguished therein and very little passes out the inlet opening 22.

The air inlet and outlet openings in the muffler 10 are preferably in the end caps and preferably centrally located therein, however, neither of these arrangements is essential. An advantage of the shape of the muffler 10 is that space can be found, for example, in a dispenser 40 for such a muffler 10, whereas space may not be available for a shorter, fatter or square-shaped muffler. The muffler 10 housing can be any size and shape. The distal ends of the tubes overlap and, preferably, the tubes curve rather than being straight. The proximal ends of the tubes preferably originate in opposite ends of the muffler housing. The openings in the distal ends of the tubes preferably face in opposite directions.

While the preferred embodiment of this invention has been described above in detail, it is to be understood that variations and modifications can be made therein without departing from the spirit and scope of the present invention.

What is claimed is:

1. A method for reducing noise comprising the steps of:

(a) providing a beverage dispenser with a reciprocating piston air compressor mounted inside of said dispenser;

(b) providing said air compressor with an air inlet and a compressor inlet tube connected at one end to said air inlet;

(c) providing a noise reduction muffler inside of said dispenser;

(d) providing said muffler with;

(i) a cylindrical, elongated, imperforate, hollow housing enclosing a chamber;

(ii) providing said housing with an end disc connected to each end of said body and providing an air inlet opening centrally located in one end disc and providing an air outlet opening centrally located in the other end disc;

(iii) providing an air inlet tube located in said chamber and having a length greater than 50% of the length of said chamber and having a cross-sectional area substantially less than half of that of said chamber and connected at its proximal end to said air inlet opening and having an air outlet opening in the distal end thereof;

(iv) providing an air outlet tube located in said chamber and having a length greater than 50% of the length of said chamber and having a cross-sectional area substantially less than half of that of said chamber and connected at its proximal end to said air outlet opening and having an air inlet opening in a distal end thereof;

(e) facing said air outlet opening of said air inlet tube and said air inlet opening of said air outlet tube in opposite directions;

(f) curving said tubes away from each other; and (g) connecting the other end of said compressor inlet tube to said air outlet opening of said muffler, to reduce the noise made by said reciprocating piston air compressor.

* * * * *